US007670186B2

(12) United States Patent
Ting et al.

(10) Patent No.: US 7,670,186 B2
(45) Date of Patent: Mar. 2, 2010

(54) ELECTRICAL CARD CONNECTOR ASSEMBLY

(75) Inventors: Chien-Jen Ting, Tu-cheng (TW); Kuo-Lung Lin, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/148,817

(22) Filed: Apr. 23, 2008

(65) Prior Publication Data

US 2008/0261418 A1 Oct. 23, 2008

(30) Foreign Application Priority Data

Apr. 23, 2007 (TW) ..... 96206452 U

(51) Int. Cl.
*H01R 24/00* (2006.01)

(52) U.S. Cl. ..... 439/630

(58) Field of Classification Search ..... 439/607, 439/157–158, 187–188, 541.5, 630; 200/51.1
See application file for complete search history.

(56) References Cited

U.S. PATENT DOCUMENTS

| | | | | |
|---|---|---|---|---|
| 6,193,547 | B1 * | 2/2001 | Tung | 439/541.5 |
| 6,394,843 | B1 * | 5/2002 | Chang et al. | 439/607 |
| 6,540,557 | B1 | 4/2003 | Yu | |
| 6,593,523 | B2 * | 7/2003 | Okada et al. | 174/377 |
| 6,641,441 | B2 * | 11/2003 | Liu | 439/630 |
| 6,764,327 | B2 * | 7/2004 | Yu | 439/188 |
| 6,872,880 | B2 * | 3/2005 | King et al. | 174/372 |
| 6,997,743 | B1 * | 2/2006 | Su et al. | 439/567 |
| 7,234,969 | B2 * | 6/2007 | Chang et al. | 439/630 |
| 7,277,301 | B2 * | 10/2007 | Liang | 361/816 |
| 7,303,442 | B2 * | 12/2007 | Fan | 439/630 |
| 7,351,107 | B1 * | 4/2008 | Burlock | 439/607 |
| 7,357,677 | B2 * | 4/2008 | Liu | 439/630 |
| 7,422,475 | B2 * | 9/2008 | Hirata | 439/541.5 |
| 7,422,485 | B2 * | 9/2008 | Yu et al. | 439/630 |
| 2003/0119364 | A1 * | 6/2003 | Liu | 439/630 |
| 2004/0214474 | A1 * | 10/2004 | Tsai | 439/630 |

* cited by examiner

*Primary Examiner*—T C Patel
*Assistant Examiner*—Harshad C Patel
(74) *Attorney, Agent, or Firm*—Andrew C. Cheng; Wei Te Chung; Ming Chieh Chang

(57) ABSTRACT

An electrical card connector assembly includes an electrical card connector (100) and a PCB (4) where the electrical card connector is assembled. The electrical card connector includes a metal shield (1), an insulating housing (2) and a terminal module (3) received in the insulating housing. The insulating housing associates with the metal shield to define a card receiving room. The metal shield forms a base (10) and a plurality of sidewalls (11) extending from the base. Each sidewall forms a locking portion (111) thereof. Each locking portion has a vertical portion (1110) and a horizontal portion (1111) extending from a lower end of the vertical portion. At least one of the sidewalls forms an elastic piece (12) extending along a card insertion/ejection direction and the elastic piece forms a declined portion (120). The PCB defines a plurality of cutouts (44) and at least one aperture (47). The elastic piece is locked with the aperture under a guiding force of the declined portion while the horizontal portions of the locking portions pass through the cutouts and then confront the bottom surface of the PCB.

10 Claims, 11 Drawing Sheets

ELECTRICAL CARD CONNECTOR ASSEMBLY

BACKGROUND OF THE INVENTION

1. Field of the Invention

The present invention relates generally to electrical card connector assemblies, and more particularly to an assembly having an electrical card connector and a printed circuit board (PCB), where the electrical card connector is assembled.

2. Description of Related Arts

Two traditional methods of assembling an electrical card connector onto a PCB are a screwing method and a soldering method. However, these two methods are troublesome and time-consuming because of screwing and soldering process. An unusual assembling method, as known, is disclosed by a PC card connector having an insulating housing, a top shield, a bottom shield and a grounding plate for preventing EMI. The top shield forms a pair of retention tabs, each having a vertical portion and a horizontal portion. The bottom shield forms a pair of cutouts defined in a rear end thereof, which is approximately shaped in a character "T". The bottom shield further comprises a pair of extending tabs, and correspondingly, the grounding plate comprises a pair of slits. In assembly, the retention tabs of the top shield are first aligned with and extend through the cutouts of the bottom shield. And then, the bottom shield moves in a front-to-rear direction until the extending tabs are aligned with and inserted into the corresponding slits of the grounding plate. Meanwhile, each retention tab moves from a first slot into a second slot of the cutout, whereby a horizontal portion of the retention tab presses against a flat surface of the bottom shield, and a vertical portion abuts against a front edge of the second slot. The bottom shield is assembled to the connector thereby. However, if the extending tab can be inserted into the slit in practice, the extending tab is easily divorced from the slit along an opposite direction; that means, the bottom shield is assembled to the connector not firmly.

Hence, an improved electrical card connector assembly is desired.

SUMMARY OF THE INVENTION

Accordingly, an object of the present invention is to provide an electrical card connector assembly having an electrical card connector and a PCB, which two are firmly assembled.

To achieve the above object, an electrical card connector assembly includes an electrical card connector and a PCB where the electrical card connector is assembled. The electrical card connector includes a metal shield, an insulating housing and a terminal module received in the insulating housing. The insulating housing associates with the metal shield to define a card receiving room. The metal shield forms a base and a plurality of sidewalls extending from the base. Each sidewall forms a locking portion thereof. Each locking portion has a vertical portion and a horizontal portion extending from a lower end of the vertical portion. At least one of the sidewalls forms an elastic piece extending along a card insertion/ejection direction and the elastic piece forms a declined portion. The PCB defines a plurality of cutouts and at least one aperture. The elastic piece is locked with the aperture under a guiding force of the declined portion while the horizontal portions of the locking portions pass through the cutouts and then confront the bottom surface of the PCB.

Other objects, advantages and novel features of the invention will become more apparent from the following detailed description when taken in conjunction with the accompanying drawings.

DETAILED DESCRIPTION OF THE PREFERRED EMBODIMENT

FIGS. 1-6 illustrate an electrical card connector assembly includes an electrical card connector 100 and a PCB 4 where the electrical card connector 100 is assembled. The electrical card connector 100 comprises a metal shield 1, an insulating housing 2 and a terminal module 3, which is installed on the PCB 4 and also received in the insulating housing 2. The metal shield 1 associates with the insulating housing 2 to define a card receiving room (not labeled) for receiving an electrical card, and accordingly, a card insertion/ejection direction is also defined.

Figure 1:
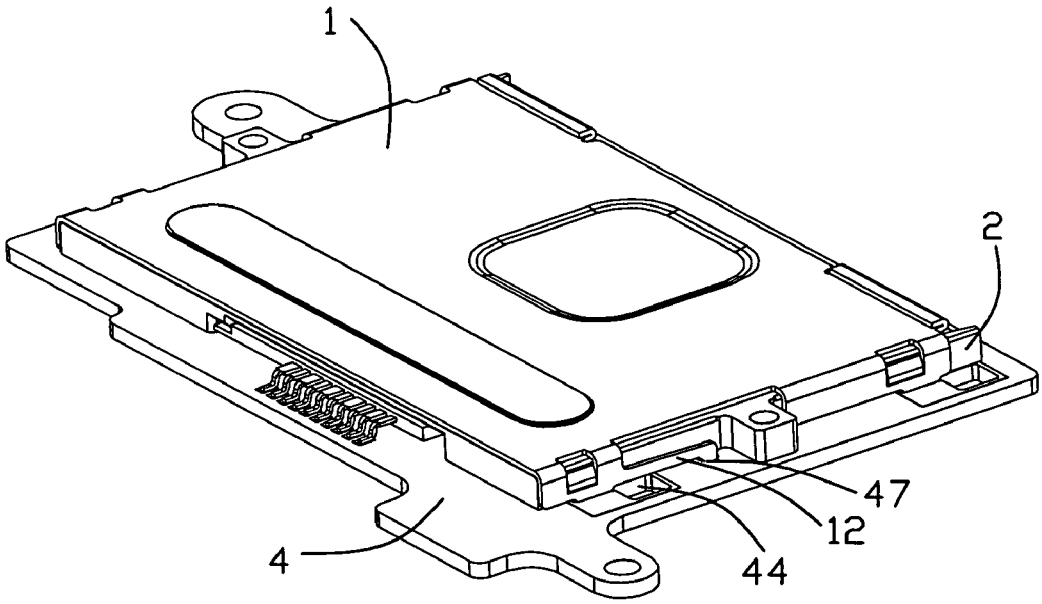
FIG. 1 is a perspective, assembled view of an electrical card connector assembly having an electrical card connector and a PCB in a first embodiment in accordance with the present invention.
Figure 2:
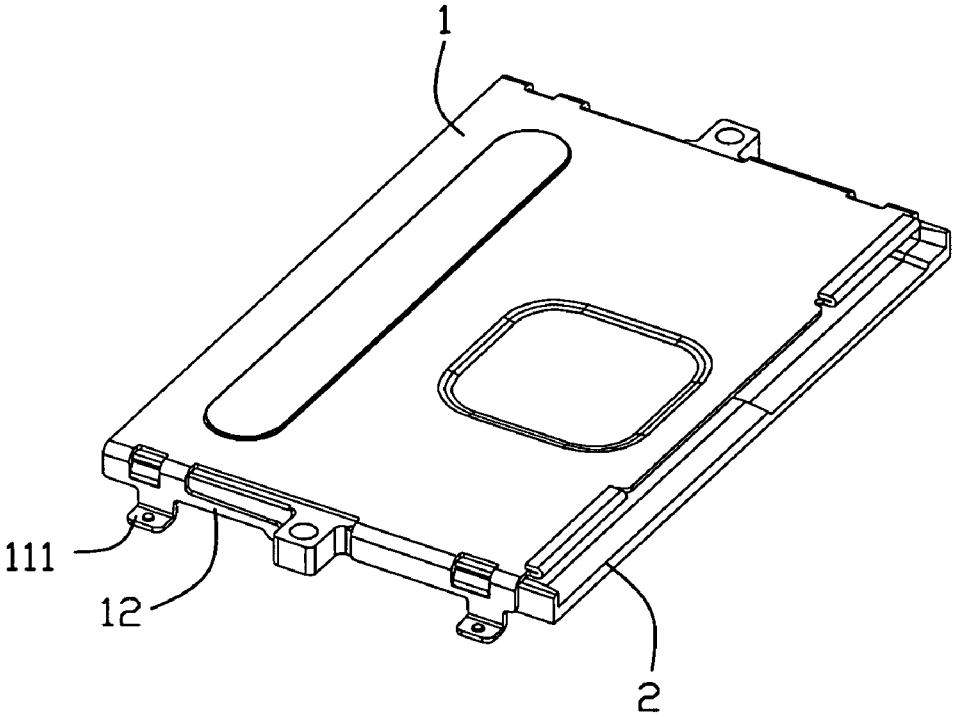
FIG. 2 is a perspective, partly exploded view of the electrical card connector assembly of FIG. 1.
Figure 2:
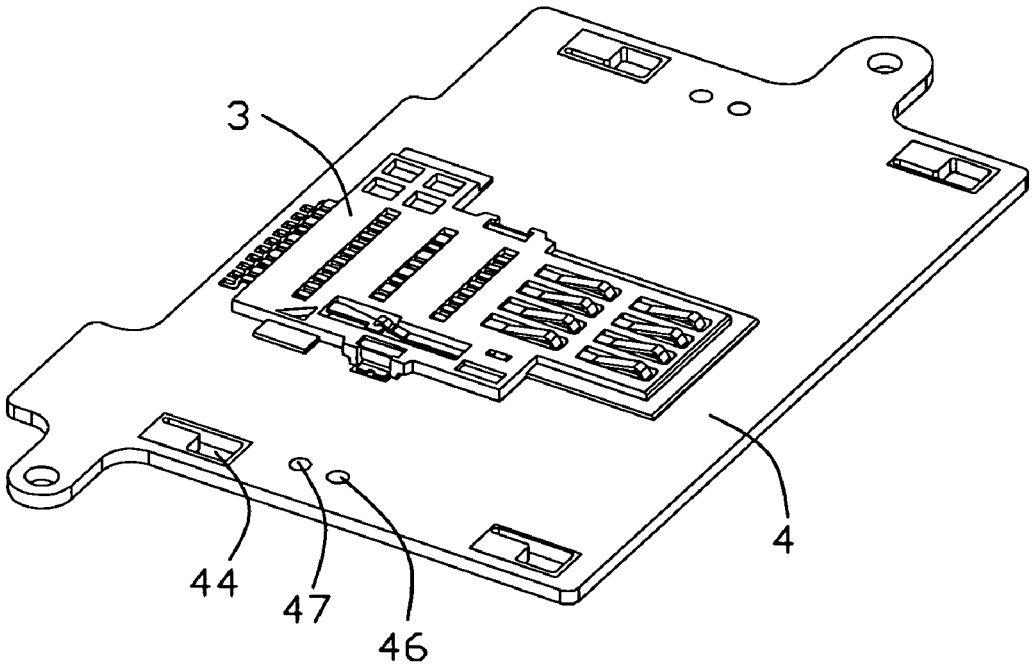
Figure 3:
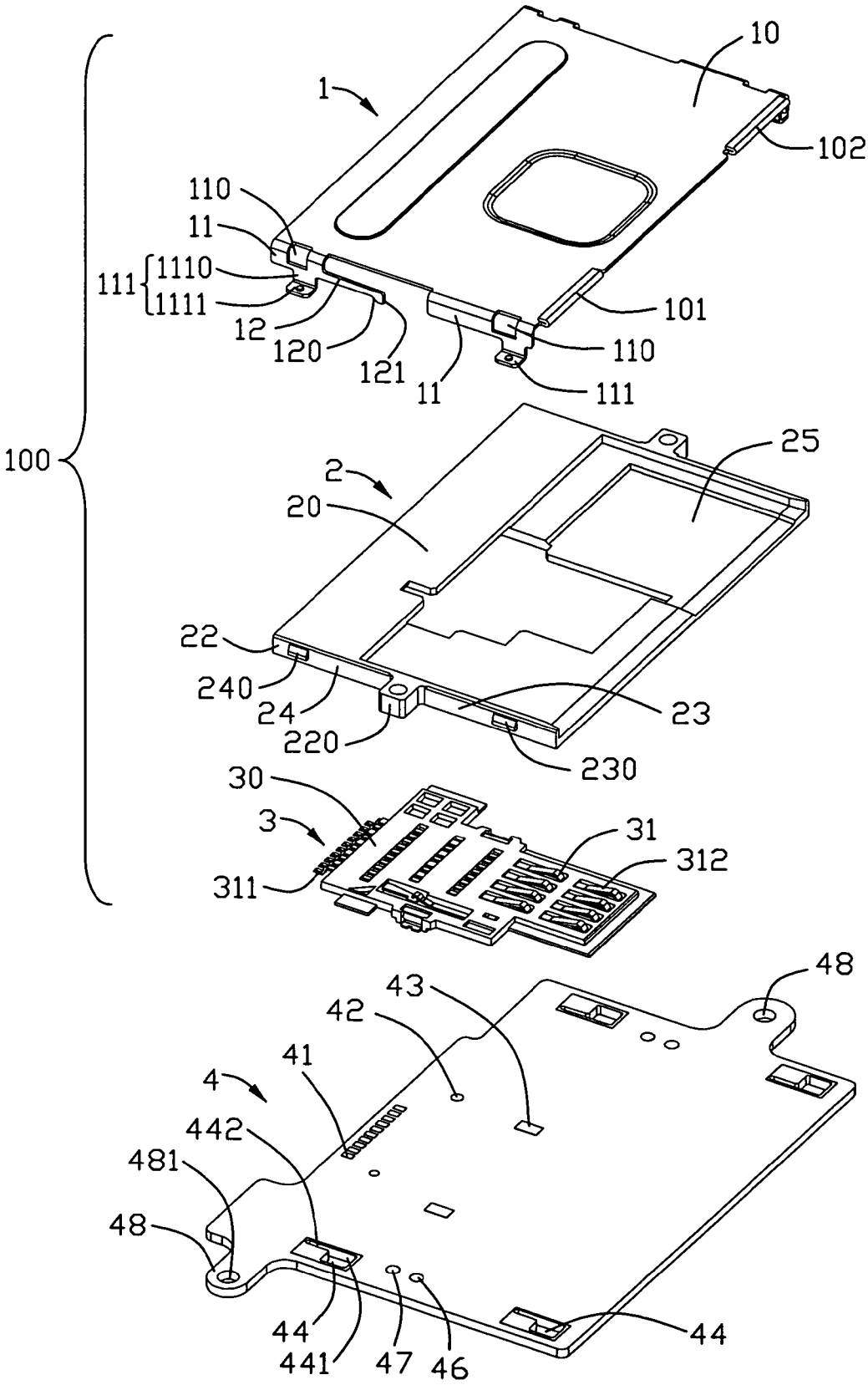
FIG. 3 is a perspective, further exploded view of the electrical card connector assembly than FIG. 2.

Referring to FIGS. 2 and 3, the metal shield 1 forms a base 10 and a plurality of sidewalls 11 extending downwardly from two edges of the base 10. Each sidewall 11 defines an opening 110 and forms a locking portion 111 having a vertical portion 1110 and a horizontal portion 1111 extending horizontally from a lower end of the vertical portion 1110. An interspace is arranged between the sidewalls 11 on the same edges and an elastic piece 12 extending from one of the sidewalls 11, along the card insertion/ejection direction, into the interspace. The elastic piece 12 comprises a free end having a declined portion 120 for guiding purpose and a confronting portion 121 standing in an approximately vertical direction for resisting purpose. The base 10 comprises a pair of guiding surfaces 101, 102 bending upward from a front end thereof for guiding the insertion of the electrical card and preventing the electrical card from being scrapped.

Figure 4:
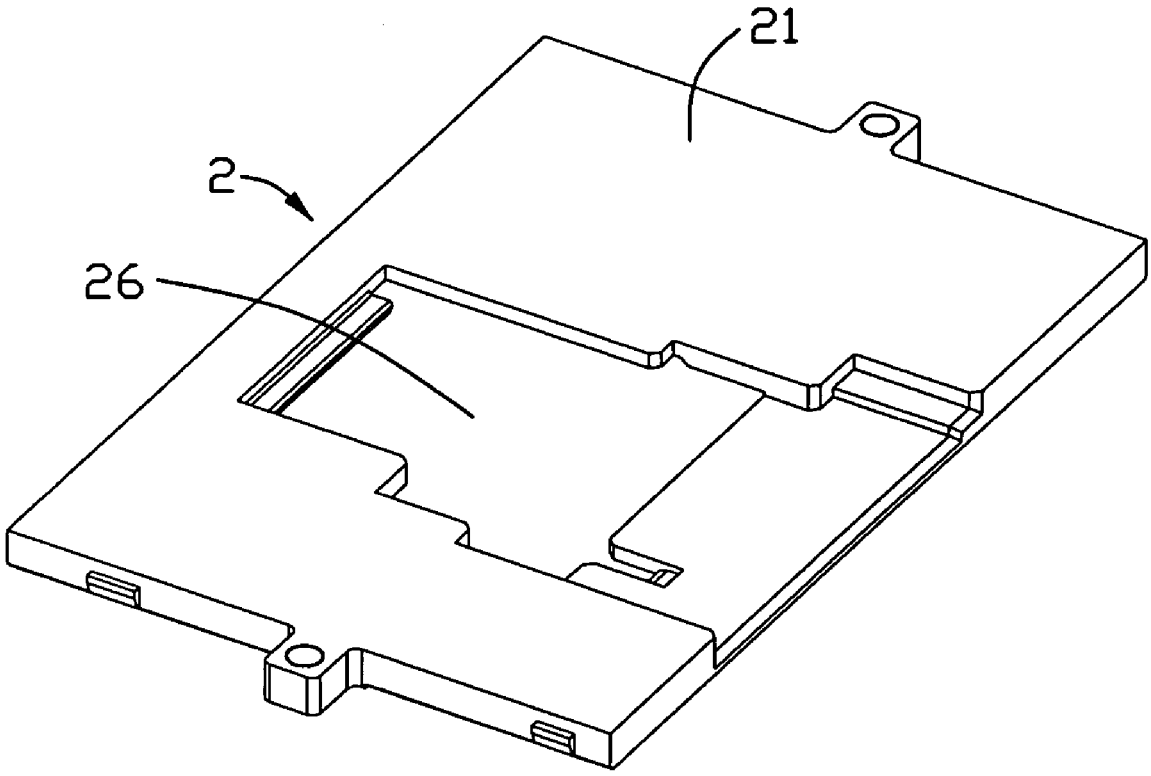
FIG. 4 is a view of the insulating housing of the electrical card connector.

Referring to FIGS. 3-4, the insulating housing 2 comprises an upper surface 20, a bottom surface 21 and lateral walls 22. Each lateral wall 22 forms a divisional portion 220 in the middle thereof, and the lateral wall 22 is divided into a first lateral wall 23 and a second lateral wall 24 by the divisional portion 220. The first lateral wall 23 and the second lateral wall 24, each has a plurality of protrusions 230, 240 correspondingly received in the openings 110 for associating the metal shield 1 with the insulating housing 2. The upper surface 20 of the insulating housing 2 comprises a depressed portion 25 at a front part thereof for forming the card receiving room. The bottom surface 21 of the insulating housing 2 comprises a receiving portion 26 at a rear part thereof for receiving the terminal module 3.

Figure 5:
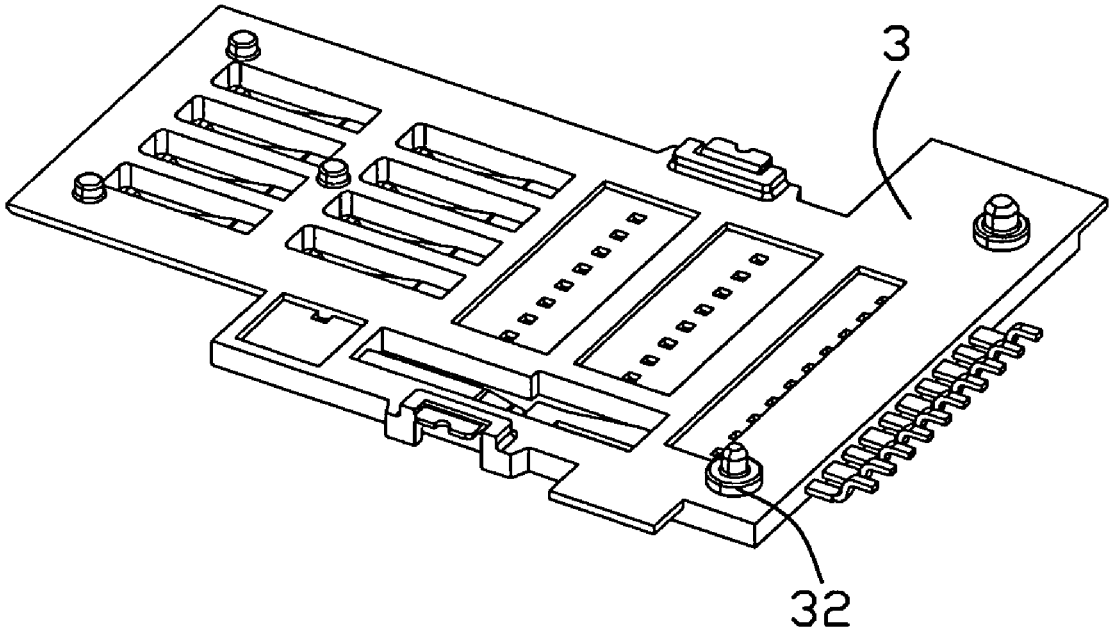
FIG. 5 is a view of the terminal module of the electrical card connector.
Figure 6:
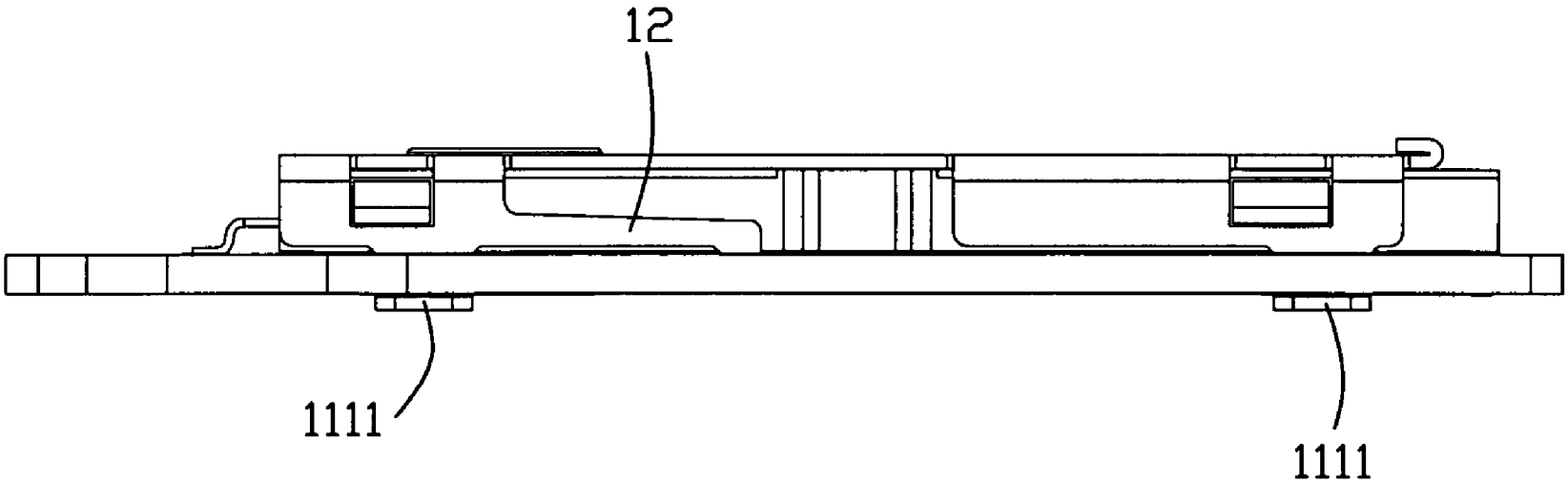
FIG. 6 is a left side view of the electrical card connector assembly.
Figure 7:
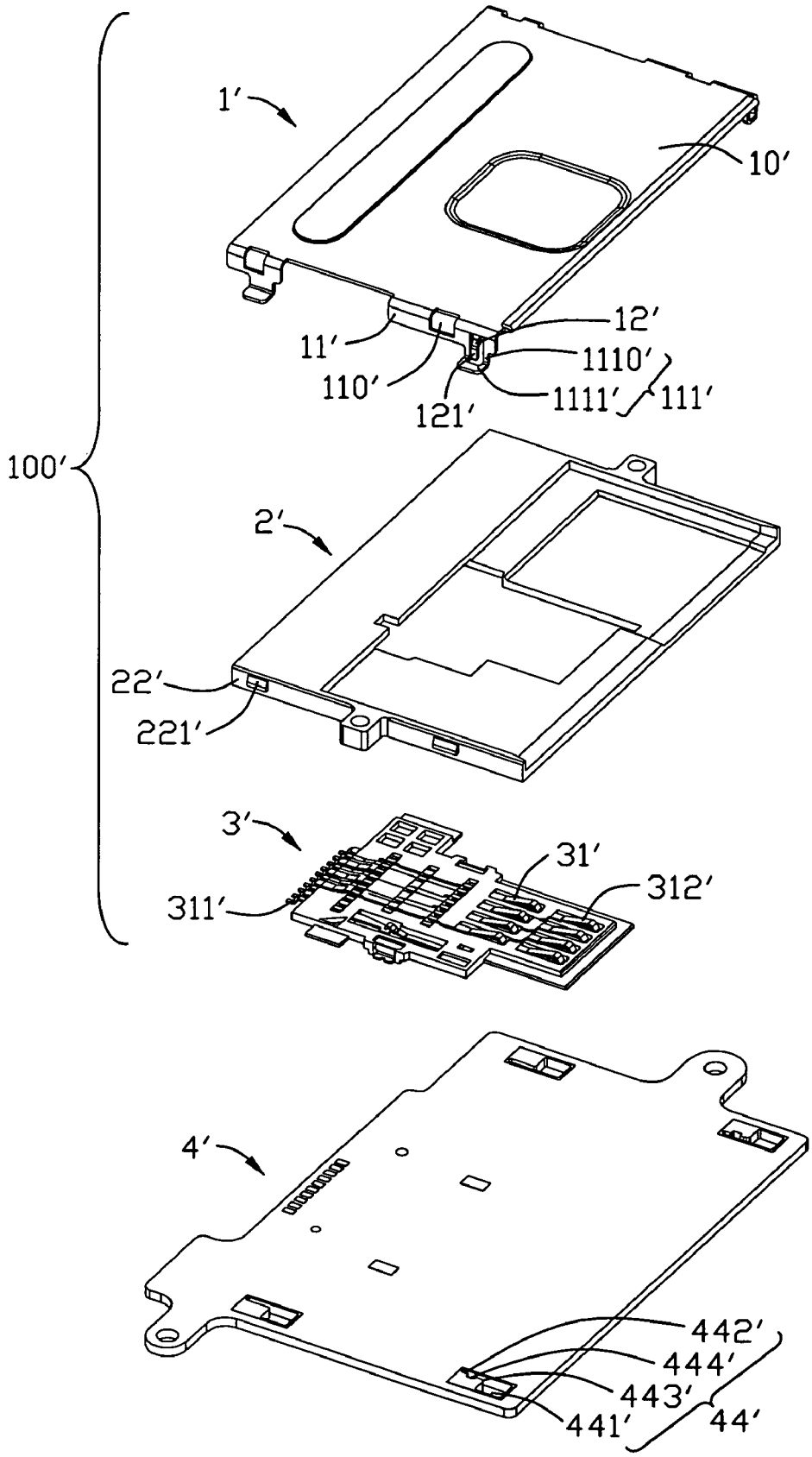
FIG. 7 is a perspective, fully exploded view of an electrical card connector assembly in a second embodiment according to the prevent invention.
Figure 8:
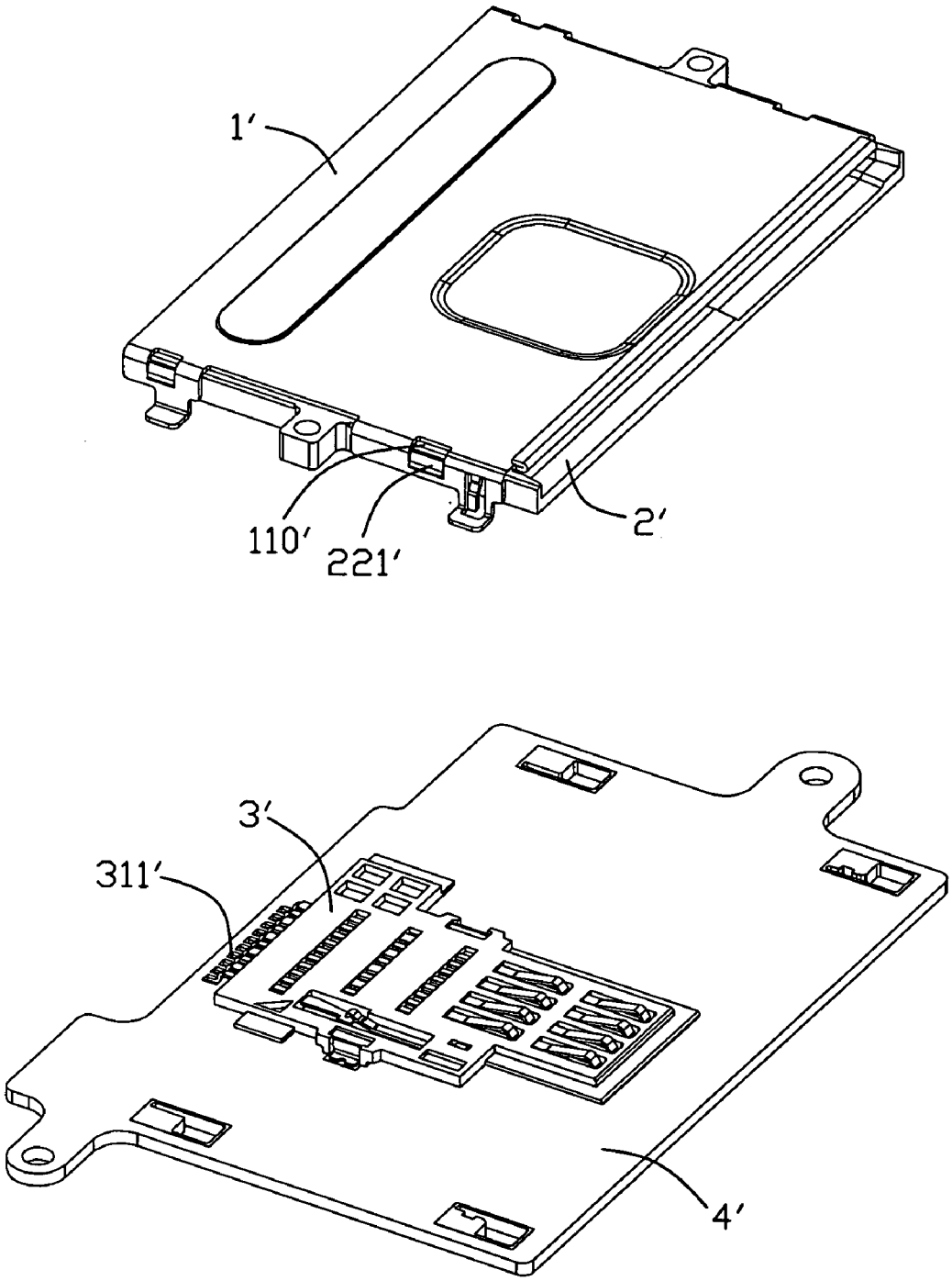
FIG. 8 is a perspective, partly exploded view of the electrical card connector assembly.
Figure 9:
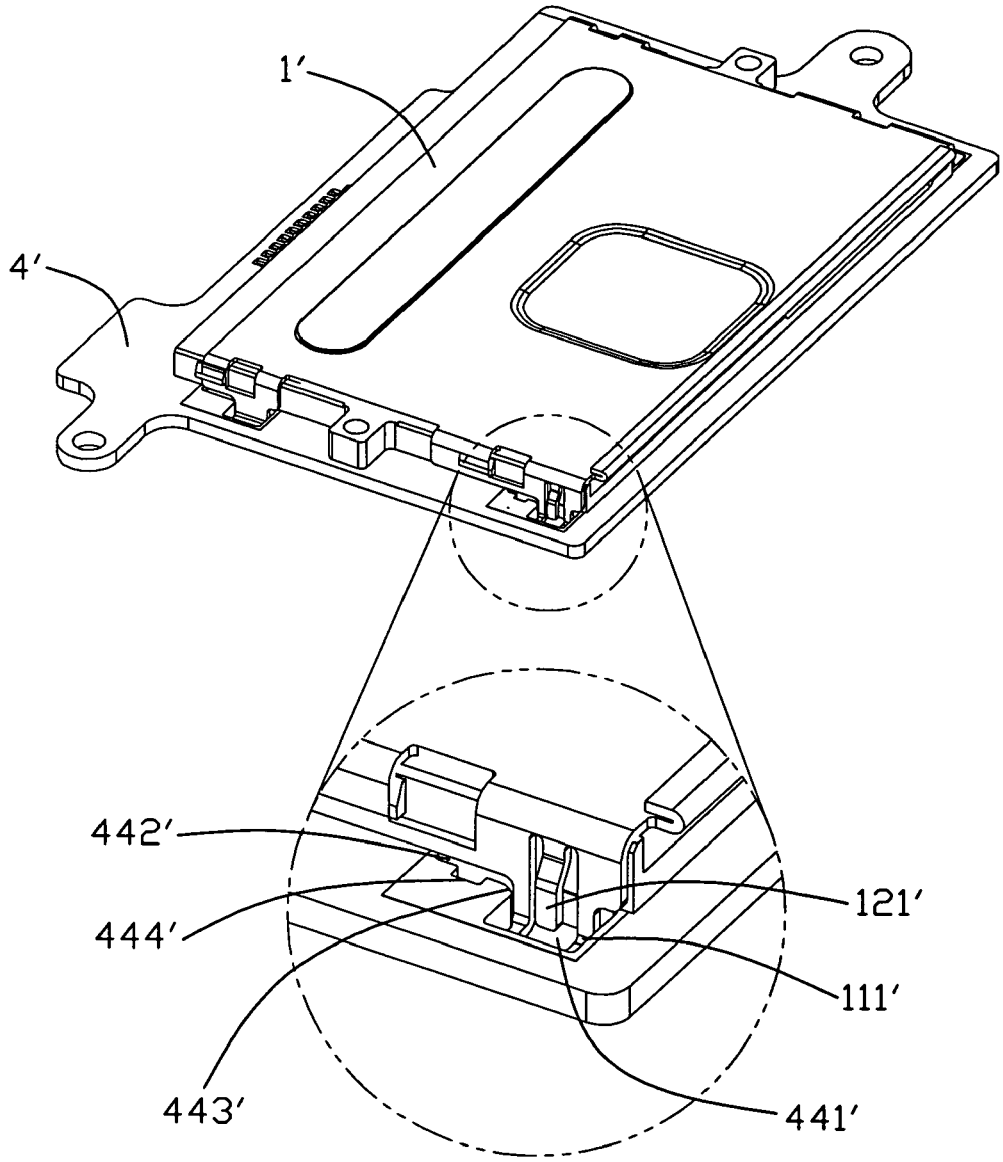
FIG. 9-11 is a view of the process of the electrical card connector integrated with the PCB.
Figure 10:
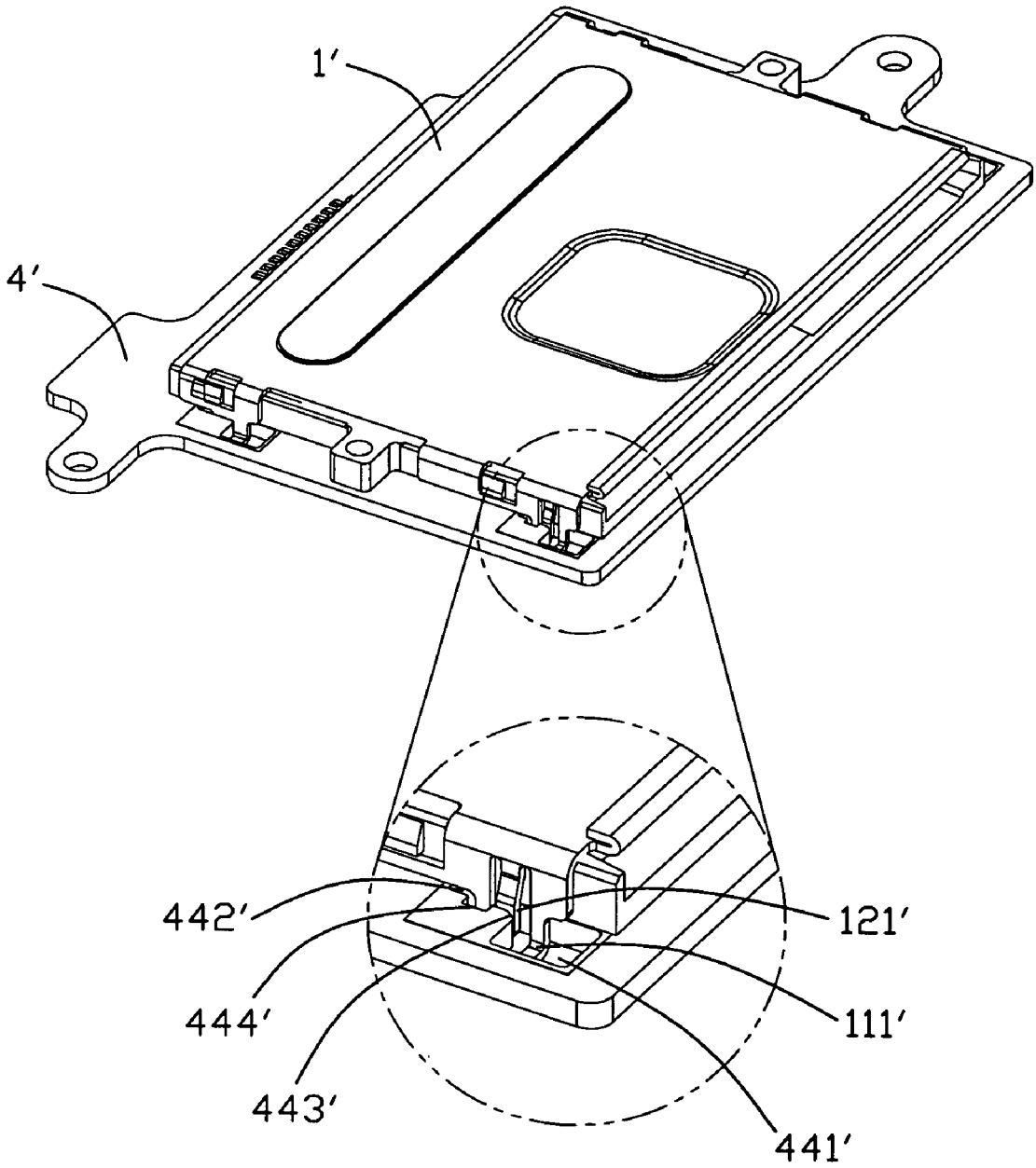
Figure 11:
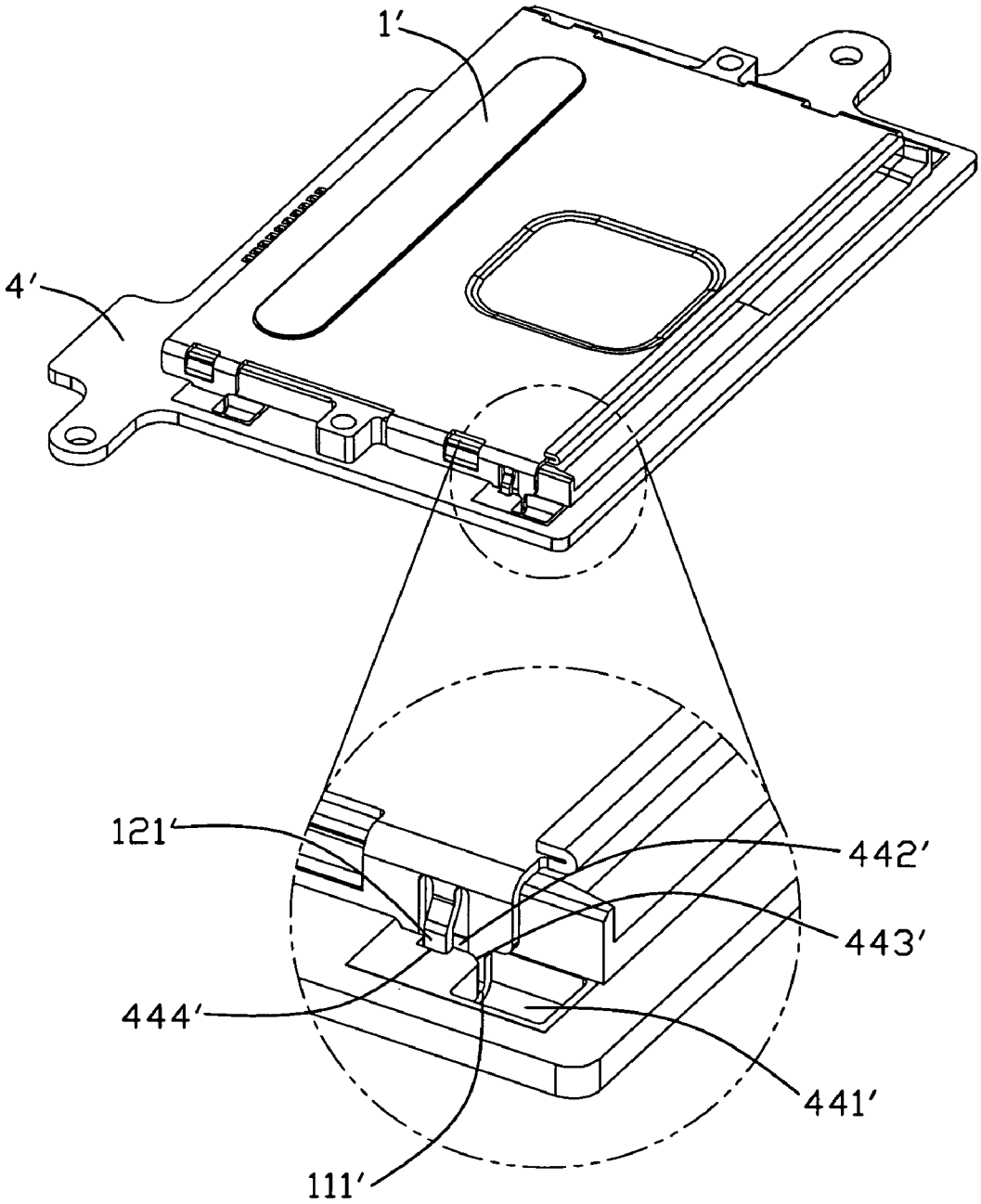

Referring to FIGS. 3 and 5, the terminal module 3 comprises a body portion 30 and a plurality of signal terminals 31 each having a soldering portion 311 and a contacting portion 312. The signal terminals 31 are arranged in two row-arrays along the card insertion/ejection direction and the contacting portions 312 extend beyond a top surface of the body portion 30 and into the card receiving room so as to electrically contact with the electrical card. The body portion 30 forms a pair of protruding tabs 32 on a bottom surface thereof for assembling the terminal module 3 on the PCB 4.

Referring to FIGS. 2-3, the PCB 4 comprises soldering pads 41, a pair of receiving holes 42 and a pair of soldering pieces 43. A pair of cutouts 44 are defined in each edge of the PCB 4. As is clearly shown in FIG. 3, the cutout 44 is like a character "P" in shape, and includes a first slot 441 and a second slot 442 communicating with the first slot 441 at a side part thereof. The width of the first slot 441 is larger than that of the second slot 442. A first aperture 46 and a second aperture 47 are located between the pair of cutouts 44 in the same edge of the PCB 4. The PCB 4 further comprises a pair of tongue portions 48 extending diagonally from the PCB 4 and each having a perforation 481 for screwing the PCB 4 onto a mother board (not shown) of an electric appliance.

In assembly, firstly, the soldering portions 311 of the signal terminals 31 are soldered with the soldering pads 41 and the protruding tabs 32 of the terminal module 3 are received in the receiving holes 42 of the PCB 4, accordingly, the terminal module 3 is assembled on the PCB 4; secondly, the metal shield 1 is integrated with the insulating housing 2 because of the protrusions 230, 240 and the corresponding openings 110; following, the locking portions 111 of the metal shield 1 are first aligned with and extend through the cutouts 44 of the PCB 4, each free end of the elastic pieces 12 is located in the first aperture 46 just at this time, then, the metal shield 1 and the insulating housing 2 moves in a front-to-rear direction, until the vertical portion 1110 of each locking portion 111 moves into the second slot 442, whereby the horizontal portion 1111 of the locking portion 111 confronts a bottom surface of the PCB 4 for providing a locking force in a vertical direction, meanwhile, the elastic pieces 12 leave the first apertures 46 under the guidance of the declined portions 120 and slide into the second apertures 47. Because the confronting portions 121 of the elastic pieces 12 confront the PCB 4 in the second apertures 47, a force is produced to prevent the electrical card connector 100 from moving towards an opposite direction relative to the PCB 4.

FIGS. 7-11 illustrate another embodiment of this invention. In this embodiment, the electrical card connector assembly has a similar structure to the first embodiment. The metal shield 1' of the electrical card connector 100' comprises a sidewall 11' defining an opening 110' therein and forming a locking portion 111' having a vertical portion 1110' and a horizontal portion 1111' extending horizontally from a lower end of the vertical portion 1110'. Different to the first embodiment, the elastic piece 12' extends from the edge of the metal shield 1' just upside the locking portions 111' and has a bar 121' extending along a vertical direction. Correspondingly, the PCB 4' forms a plurality of cutouts 44' similar to the cutouts 44 in the first embodiment, each having a first slot 441' and a second slot 442' communicating with the first slot 441' at a side part thereof, but the transition region from the first slot 441' to the second slot 442' is not an acute angle, but a slant surface 443' for guiding purpose. The second slot 442' further forms a gap 444' facing towards the second slot 442' for mating with the bar 121' of the elastic piece 12'. In assembly, as is clearly shown in FIGS. 4-6, first, the locking portions 111' of the metal shield 1' are aligned with and extend through the cutouts 44' of the PCB 4', the bar 121' of the elastic piece 12' is just located in the first slot 441'; then, the metal shield 1' and the insulating housing 2' move in a front-to-rear direction, the elastic pieces 12' leave the first slots 441 under the guidance of the slant surfaces 443'; until the vertical portions 1110' of the locking portions 11' move into the second slots 442', the bars 121' of the elastic pieces 12' just slide into the gaps 444' and then are locked in the gaps 444'.

In the present invention, the electrical card connectors 100, 100' are assembled onto the PCBs 4, 4' under a guiding force provided by the declined portion 120 of the elastic piece 12 in the first embodiment and provided by the slant surface 443' at the transition region from the first slot 441' to the second slot 442' in the second embodiment. Because of the guiding force, the electrical card connectors 100, 100' are successfully assembled onto the PCBs 4, 4' along a special direction, meanwhile, the electrical card connectors 100, 100' can't move along an opposite direction, because of having no guiding force. So, the electrical card connectors 100, 100' are firmly fixed to the PCBs 4, 4'. And another advantage formed in the invention, is a simple assembling process for having no screwing or soldering steps.

While a preferred embodiment in accordance with the present invention has been shown and described, equivalent modifications and changes known to persons skilled in the art according to the spirit of the present invention are considered within the scope of the present invention as described in the appended claims.

We claim:

1. An electrical card connector assembly, comprising:

an electrical card connector, comprising:

a metal shield forming a base and a plurality of sidewalls extending from the base, each sidewall forming a locking portion and each locking portion having a vertical portion and a horizontal portion extending from a lower end of the vertical portion, at least one of the sidewalls forming an elastic piece extending along a card insertion/ejection direction and the elastic piece forming a declined portion;

an insulating housing associating with the metal shield to define a card receiving room;

a terminal module received in the insulating housing; and a PCB defining a plurality of cutouts and at least one aperture; wherein the elastic piece is locked with the aperture under a guiding force of the declined portion while the horizontal portions of the locking portions pass through the cutouts and then confront the bottom surface of the PCB.

2. The electrical card connector assembly as described in claim 1, wherein each cutout comprises a first slot and a narrower second slot communicating with the first slot.

3. The electrical card connector assembly as described in claim 1, wherein the elastic piece comprises a confronting portion standing in an approximately vertical direction at a free end thereof

4. The electrical card connector assembly as described in claim 3, wherein the aperture is arranged along a line defined by two cutouts at a same edge of the PCB.

5. The electrical card connector assembly as described in claim 1, wherein the terminal module comprises a plurality of terminals arranged in two-row arrays.

6. The electrical card connector assembly as described in claim 5, wherein each terminal has a contacting portion and a soldering portion, and the contacting portions extend beyond a top surface of the terminal module and into the card receiving room.

7. An electrical card connector assembly, comprising:

an electrical card connector, comprising:

a metal shield forming a base and a plurality of sidewalls extending from the base, each sidewall forming a locking portion and each locking portion having a vertical portion and a horizontal portion extending from a lower end of the vertical portion, at least one of the sidewalls forming an elastic piece extending along a vertical direction;

an insulating housing associating with the metal shield to define a card receiving room;

a terminal module received in the insulating housing; and a PCB defining a plurality of cutouts thereof, each cutout comprising a first slot and a narrower second slot communicating with the first slot, at least one of the cutouts forming a slant surface at the transition region from the first slot to the second slot and a gap at the second slot; wherein the elastic piece is locked with the gap under a guiding force of the slant surface and the horizontal portions of the locking portions pass through the cutouts and then confront the bottom surface of the PCB.

8. The electrical card connector assembly as described in claim 7, wherein the elastic piece is just located upside the locking portion.

9. The electrical card connector assembly as described in claim 7, wherein the terminal module comprises a plurality of terminals arranged in two-row arrays.

10. The electrical card connector assembly as described in claim 9, wherein each terminal has a contacting portion and a soldering portion, and the contacting portions extend beyond a top surface of the terminal module and into the card receiving room.

* * * * *